US008702478B2

(12) United States Patent
Loveless et al.

(10) Patent No.: US 8,702,478 B2
(45) Date of Patent: Apr. 22, 2014

(54) ANGLE GRINDER DUST SHROUD WITH UNITARY ADJUSTABLE MOUNTING COLLAR

(76) Inventors: Michael Loveless, Price, UT (US); Spencer Loveless, Price, UT (US)

( * ) Notice: Subject to any disclaimer, the term of this patent is extended or adjusted under 35 U.S.C. 154(b) by 351 days.

(21) Appl. No.: 12/775,859

(22) Filed: May 7, 2010

(65) Prior Publication Data

US 2010/0285729 A1 Nov. 11, 2010

Related U.S. Application Data

(60) Provisional application No. 61/176,626, filed on May 8, 2009.

(51) Int. Cl.
*B24B 55/05* (2006.01)

(52) U.S. Cl.
USPC ..... 451/453; 451/456; 451/358; 451/359; 24/681; 24/683

(58) Field of Classification Search
USPC ..... 451/456, 451, 452, 453, 454, 457, 344, 451/353, 354, 356, 357, 358, 359; 144/252.1; 403/361, 326; 24/681, 683, 24/685, 686
See application file for complete search history.

(56) References Cited

U.S. PATENT DOCUMENTS

| | | | | | |
|---|---|---|---|---|---|
| 415,127 | A | * | 11/1889 | Siegfried | 144/251.2 |
| 437,004 | A | * | 9/1890 | Shipley | 24/662 |
| 907,734 | A | | 12/1908 | Butterfield | |
| 1,123,562 | A | | 1/1915 | Lund | |
| 1,197,967 | A | * | 9/1916 | Swenson | 24/681 |
| 1,302,263 | A | * | 4/1919 | Woodworth | 24/681 |
| RE15,262 | E | | 1/1922 | Gurgel | |
| 1,432,660 | A | * | 10/1922 | Bourque | 24/681 |
| 1,643,882 | A | | 9/1927 | Faiver | |
| 1,850,504 | A | * | 3/1932 | Janes | 24/680 |
| 2,032,382 | A | | 3/1936 | Torrison | |
| 2,041,689 | A | | 5/1936 | Baumeister et al. | |
| 2,212,361 | A | * | 8/1940 | Arthur | 29/6.1 |
| 2,279,186 | A | | 4/1942 | Terry et al. | |
| 2,291,269 | A | | 7/1942 | Wiggleworth | |
| 2,294,272 | A | | 8/1942 | Boice | |
| 2,312,443 | A | * | 3/1943 | Reiter | 24/680 |
| 2,384,688 | A | | 9/1945 | Morris | |

(Continued)

FOREIGN PATENT DOCUMENTS

| | | |
|---|---|---|
| EP | 556713 | 8/1993 |
| EP | 0579964 | 1/1994 |

(Continued)

*Primary Examiner* — Joseph J Hail
*Assistant Examiner* — Joel Crandall
(74) *Attorney, Agent, or Firm* — Pate Peterson PLLC; Brett Peterson

(57) ABSTRACT

A universal dust shroud includes a unitary mounting bracket on top of the shroud body. The bracket includes a plurality of collar sections attached to the body via a 'Z' shaped joint which allows the collar sections to move radially inwardly and outwardly relative to each other to accommodate different angle grinders. The bracket may include slots formed at the base of the bracket. The slots allow air to flow in through the slots, out past the grinding disk, and to the vacuum port. As such, the slots can aid in cooling the grinder output and bearings, and helps keep dust and debris away from the bearings in order to extend the life of the grinder.

18 Claims, 4 Drawing Sheets

(56) References Cited

U.S. PATENT DOCUMENTS 2,440,684 A * 5/1948 Huelster ..... 24/681
2,440,685 A * 5/1948 Huelster ..... 24/681
2,503,854 A 4/1950 Trainor
2,520,725 A 8/1950 Judd
2,803,098 A 8/1957 Robert et al.
2,817,134 A * 12/1957 Fenton ..... 24/681
2,819,570 A 1/1958 Tocci-Guilbert et al.
2,819,571 A 1/1958 Morgan
2,994,995 A 8/1961 Griffith
3,166,877 A 1/1965 Reames
3,256,648 A 6/1966 Subonovich
3,468,076 A 9/1969 Jones
3,667,170 A 6/1972 MacKay
3,673,744 A 7/1972 Oimoen
3,835,543 A 9/1974 Polydoris et al.
3,848,686 A 11/1974 Jysky et al.
3,862,521 A 1/1975 Isaksson
3,882,598 A 5/1975 Earle et al.
3,882,644 A 5/1975 Cusumano
3,945,281 A 3/1976 Kreitz
3,987,589 A 10/1976 Marton
4,063,478 A 12/1977 Stuy
4,090,297 A 5/1978 Wanner et al.
4,135,334 A 1/1979 Rudiger
4,201,256 A 5/1980 Truhan
4,253,362 A 3/1981 Olson
4,326,864 A 4/1982 Sittler
4,367,665 A 1/1983 Terpstra et al.
4,381,628 A 5/1983 Dicke
4,400,995 A 8/1983 Palm
4,574,532 A 3/1986 Haberle et al.
4,576,072 A 3/1986 Terpstra et al.
4,622,782 A 11/1986 Roestenberg
4,641,401 A * 2/1987 Hasegawa ..... 24/681
4,697,389 A 10/1987 Romine
4,761,877 A 8/1988 Rupp
4,782,632 A 11/1988 Matechuk
4,868,949 A 9/1989 Loveless et al.
4,921,375 A 5/1990 Famulari
4,932,163 A 6/1990 Chilton et al.
4,932,164 A 6/1990 Sullivan et al.
5,033,552 A 7/1991 Hu
5,074,044 A 12/1991 Duncan et al.
5,084,972 A 2/1992 Waugh
5,105,585 A 4/1992 Hampl et al.
5,125,190 A 6/1992 Buser et al.
5,131,192 A 7/1992 Cheng
5,163,252 A 11/1992 Garner et al.
5,167,215 A 12/1992 Harding, Jr.
5,176,408 A * 1/1993 Pedersen ..... 285/42
5,201,785 A 4/1993 Nagano
5,237,781 A 8/1993 Demetrius
5,327,649 A 7/1994 Skinner
5,339,571 A 8/1994 Timmons et al.
5,411,433 A 5/1995 Keller
5,435,066 A 7/1995 Bare et al.
5,440,809 A 8/1995 Padilla
5,445,056 A 8/1995 Folci
5,545,082 A 8/1996 Courson et al.
5,558,571 A 9/1996 Toyoshima et al.
5,564,408 A 10/1996 Bassols
5,566,457 A 10/1996 Batschari et al.
5,575,035 A 11/1996 Reis et al.
5,582,225 A 12/1996 Schank
5,588,213 A 12/1996 Swanberg
5,609,516 A 3/1997 Courson et al.
5,653,561 A 8/1997 May
5,675,895 A 10/1997 Mori et al.
5,688,082 A 11/1997 Richardson
5,704,956 A 1/1998 Loveless et al.
5,713,785 A 2/1998 Nishio
D392,531 S 3/1998 Richardson
5,774,992 A 7/1998 Lindenmuth
5,791,979 A 8/1998 Duncan et al.
5,816,733 A 10/1998 Ishikawa et al.
5,819,619 A 10/1998 Miller et al.
5,931,072 A 8/1999 Shibata
5,954,863 A 9/1999 Loveless et al.
6,027,399 A * 2/2000 Stewart ..... 451/353
6,053,674 A 4/2000 Thompson
6,108,912 A 8/2000 Radigan
6,138,317 A 10/2000 Holmes et al.
6,167,626 B1 1/2001 Doumani et al.
6,183,527 B1 2/2001 O'Banion et al.
6,219,922 B1 4/2001 Campbell et al.
6,273,081 B1 8/2001 Gorgol et al.
6,318,352 B1 11/2001 Gnazzo et al.
6,347,985 B1 2/2002 Loveless
6,470,778 B1 10/2002 Kaye, Jr. et al.
6,471,574 B1 10/2002 Rupprecht et al.
6,557,261 B1 5/2003 Buser et al.
6,648,742 B1 11/2003 Segiel Jr.
6,679,145 B1 1/2004 Lee
6,699,114 B1 3/2004 Booeshaghi et al.
6,726,554 B1 4/2004 Chen et al.
6,748,660 B2 6/2004 Buser et al.
6,796,208 B1 9/2004 Jorgensen
6,811,476 B2 11/2004 Ohlendorf
6,823,907 B2 11/2004 Cheng
6,860,799 B2 3/2005 Loveless
6,878,050 B2 4/2005 Wendt et al.
6,896,605 B2 5/2005 Ohlendorf
6,902,594 B2 6/2005 Cho
6,935,939 B1 8/2005 Buser et al.
6,948,412 B2 9/2005 Brazell et al.
6,960,124 B2 11/2005 Lee
7,013,884 B2 3/2006 Guth
7,044,039 B2 5/2006 Powell
7,044,843 B1 5/2006 Lin
7,047,647 B1 5/2006 Muller et al.
7,047,650 B2 5/2006 Chen
7,069,831 B2 7/2006 Chang
7,171,880 B2 2/2007 Powell
7,195,429 B2 3/2007 Dods et al.
7,197,826 B2 4/2007 Baxivanelis et al.
7,198,559 B2 4/2007 Walstrum et al.
7,204,178 B2 4/2007 Bergmann
7,216,572 B2 5/2007 Keenan
7,222,560 B2 5/2007 Parks et al.
7,223,161 B2 5/2007 Kodani et al.
7,300,337 B1 11/2007 Sun et al.
7,438,633 B2 10/2008 Jespersen
7,578,063 B2 8/2009 Martin
7,625,265 B2 12/2009 Woods et al.
7,635,293 B2 12/2009 Sun et al.
7,661,195 B1 2/2010 Wood et al.
7,740,086 B2 6/2010 Bleicher et al.
7,887,624 B2 2/2011 Ekstrom et al.
7,892,075 B2 2/2011 Esenwein
7,985,042 B1 * 7/2011 Paxton ..... 411/527
8,282,447 B1 * 10/2012 Buser ..... 451/451
2004/0206220 A1 10/2004 Keenan
2005/0088866 A1 4/2005 Levine
2005/0155233 A1 7/2005 Chen
2006/0005681 A1 1/2006 Lambert et al.
2006/0019585 A1 1/2006 Zayat
2007/0079589 A1 4/2007 Ekstrom et al.
2007/0155296 A1 7/2007 Hofmann et al.
2007/0178815 A1 8/2007 Buser
2007/0193759 A1 8/2007 Sweig et al.
2007/0251104 A1 11/2007 Heinrichs et al.
2008/0060631 A1 3/2008 Dofher
2008/0099053 A1 5/2008 Loveless
2008/0109986 A1 5/2008 Loveless
2008/0163492 A1 7/2008 Johansson
2008/0200103 A1 8/2008 Esenwein
2008/0271323 A1 11/2008 Perlmutter

(56) References Cited

U.S. PATENT DOCUMENTS

| | | | |
|---|---|---|---|
| 2009/0181604 | A1 | 7/2009 | Loveless |
| 2009/0181605 | A1 | 7/2009 | Loveless |
| 2009/0181606 | A1 | 7/2009 | Loveless |
| 2009/0183377 | A1 | 7/2009 | Loveless |
| 2009/0183800 | A1 | 7/2009 | Loveless |
| 2009/0186559 | A1 | 7/2009 | Loveless |
| 2009/0311953 | A1 | 12/2009 | Maute et al. |

FOREIGN PATENT DOCUMENTS

| | | | |
|---|---|---|---|
| GB | 2 260 721 | | 4/1993 |
| GB | 2262159 | A | 6/1993 |
| JP | 10-000559 | | 1/1998 |
| JP | 10015717 | A | 1/1998 |
| JP | 2001096525 | A | 4/2001 |
| KR | 10-2002-0056086 | | 7/2002 |
| WO | WO 9944786 | A1 | 9/1999 |

* cited by examiner

ANGLE GRINDER DUST SHROUD WITH UNITARY ADJUSTABLE MOUNTING COLLAR

PRIORITY

The present application claims the benefit of U.S. Provisional Application Ser. No. 61/176,626, filed May 8, 2009, which is herein incorporated by reference in its entirety.

THE FIELD OF THE INVENTION

The present invention relates to dust shrouds. More specifically, the present invention relates to a universal dust shroud for angle grinders.

BACKGROUND

Dust shrouds have become more commonly used for multiple purposes. Angle grinders, for example, are commonly used for grinding cement or other similar tasks. Without a dust shroud, debris is scattered over a wide area. It is desirable to contain the dust which is created for several reasons. It is desirable to contain the dust and debris to keep the workplace cleaner and to minimize the time necessary to clean up afterwards. Fine dust is often created while grinding cement or removing paint, for example, and that dust spreads over a large distance and can be quite difficult to clean up afterwards. It is also desirable to contain the dust and debris to keep the same from getting into the tool itself, causing premature failure of the bearings, motor, etc. Additionally, debris such as concrete dust or paint often poses a health risk to the machine operator and others who may breathe it. It is thus desirable to collect the dust to minimize any exposure to the dust.

One difficulty in providing dust shrouds is the fact that each particular tool will have different mounting requirements. For angle grinders, each grinder will typically have an output shaft housing which is concentric to the output shaft. The housing is typically used to attach the grinding disk guard, and may be used to mount a dust shroud to the grinder. For each grinder, however, the housing may be a different diameter and may be a different height or distance from the grinding disk. As such, the dust shroud must accommodate the particular output housing diameter and height of the desired tool. Another difficulty in providing dust shrouds is in providing a dust shroud which does not overly interfere with the use of the grinder itself.

It is thus appreciated that the requirements for a dust shroud varies according to the particular angle grinder with which the dust shroud is being used. Many stores, however, do not wish to stock many different models of dust shrouds. It is similarly not desirable for a manufacturer to make many different models of dust shrouds, as it increases the tooling and production costs. Individual consumers do not wish to special order a dust shroud and wait for weeks for it to arrive. There is thus a need for universal dust shrouds which allow a single shroud to be used with many different brands of tools while still performing properly. Such a universal dust shroud should safely and securely mount to a wide variety of angle grinders while effectively collecting dust and debris and without interfering with the use of the angle grinder.

Additionally, many persons who use an angle grinder for home repairs or projects often do not fully appreciate the importance of using a dust shroud, and do not desire to spend a significant amount of money on a dust shroud. Thus, while some sophisticated grinder dust shrouds are being developed, these are typically of sufficient expense that a person such as a hobbyist would not purchase the dust shroud. It is thus desirable to provide a simple dust shroud which meets the above criteria of being effective and universally adaptable to different grinders while also being simple and inexpensive so as to not dissuade a hobbyist or home owner from purchasing and using the dust shroud. Making a single simple dust shroud which will fit a large number of different angle grinders helps to reduce the manufacturing costs and allows the shroud to be inexpensive, encouraging people to use the shroud.

SUMMARY OF THE INVENTION

It is an object of the present invention to provide an improved universal dust shroud.

According to one aspect of the invention, a dust shroud is provided which is adjustable to fit varying diameters of output shaft housings on different tools. The dust shroud includes a mounting collar or mounting bracket which attaches to the housing of an angle grinder and which is movable radially inwardly or outwardly to accommodate the differently sized housings found on different tools.

According to another aspect of the invention, the height of the mounting collar is adjustable to properly position the shroud around the grinding disk of different angle grinders.

According to another aspect of the invention, the mounting collar is formed integrally with the shroud body so as to provide a shroud which is both inexpensive and easy to use, promoting the use thereof by hobbyists and the like.

According to another aspect of the invention, the shroud includes openings adjacent the base of the mounting collar. The openings allow for air flow around the shaft of the angle grinder and help to cool the angle grinder shaft bearings and to keep dust and debris away from the bearings. These openings help prolong the life of the grinder; particularly important when grinding cement or the like as the dust which is created is particularly damaging to bearings.

These and other aspects of the present invention are realized in a universal dust shield as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. In some cases, not all features are numbered in each drawing to more clearly illustrate other features of the invention. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
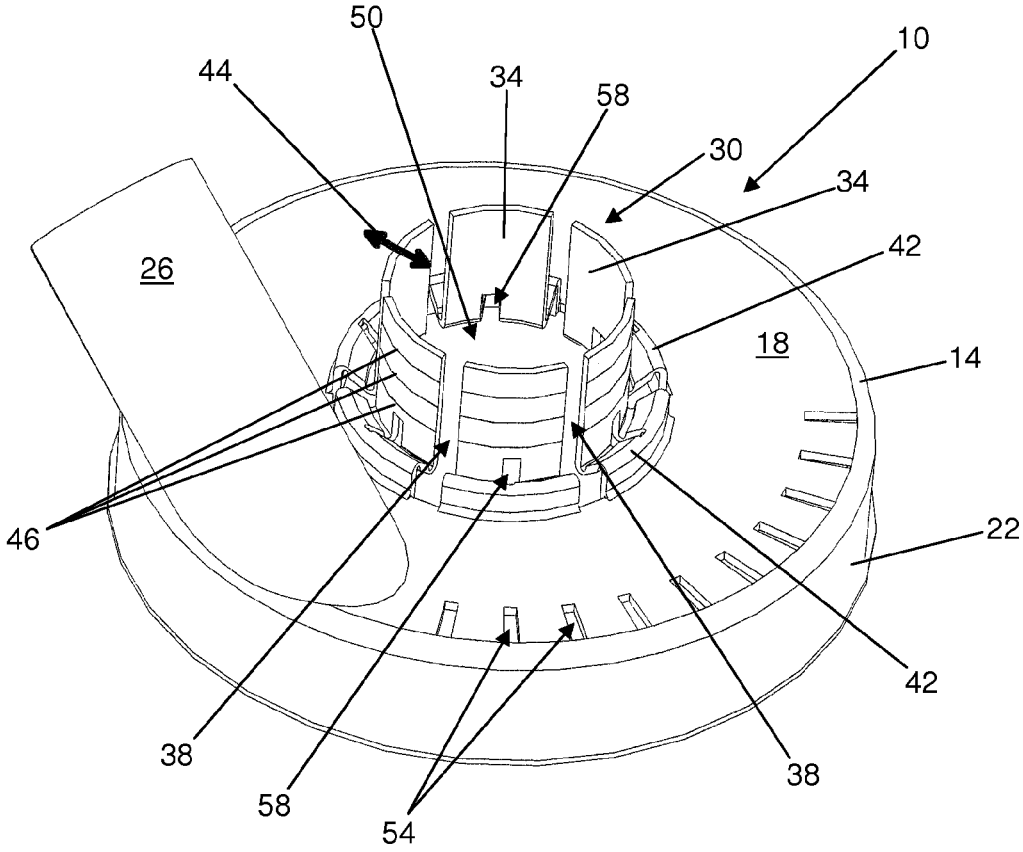
FIG. 1 shows a perspective view of a dust shroud of the present invention.

Turning now to FIG. 1, a perspective view of a shroud 10 is shown. The shroud 10 is designed to be a universal shroud for use with various different angle grinders. The shroud includes a body 14 which has a generally flat top 18 and a skirt 22 which will generally enclose the top and sides of a grinding disk when the shroud is properly mounted to an angle grinder. A vacuum port 26 is used to connect a conventional 1.25 inch vacuum hose (although other sizes of hoses could be used) to the shroud to capture the dust which is created while grinding. The vacuum port 26 is hollow and disposed in communication with the interior of the shroud body 14 so as to draw air from around the grinding disk.

The shroud 10 also includes a mounting collar 30. In order to accommodate a variety of different angle grinders with a single shroud 10, the collar 30 is segmented into a plurality of vertical sections 34 with slots 38 therebetween. The vertical collar sections 34 are each attached to the body 14 via a 'Z' or 'S' shaped joint 42 which is located at the base of the particular section 34. The joints 42 allow the collar sections 34 to move inwardly and outwardly to adjust the space between the collar sections as indicated by arrow 44, changing the size of the collar. The collar 30 is also formed with circumferential lines or ridges 46 which designate different vertical heights around the collar.

In use, the height of the collar 30 is adjusted by trimming off the top portion of the collar if necessary in order to adjust the position of the shroud body 14 relative to the grinder and properly locate the grinding disk axially within the body 14. The lines 46 guide the user in trimming the collar. A clamp such as a worm drive hose clamp (not shown) is then placed around the collar 30 and tightened in order to pull the collar sections 34 inwardly and thereby securely fasten the collar sections 34 to an angle grinder so that the output shaft of the angle grinder passes through the hole 50 formed by the collar 30. The collar 30 is clamped to the output shaft housing on the angle grinder.

As discussed, the 'Z' shaped joints 42 flex and allow the collar sections 34 to move radially inwardly or outwardly to fit the grinder properly. As discussed, the mounting collar sections 34 are clamped against the output shaft collar/bearing housing which is located around the output shaft of an angle grinder. Once the collar sections 34 are clamped against the grinder, the 'Z' shaped joints 42 are held in a fairly rigid position, largely keeping the shroud body 14 from moving both horizontally and vertically relative to the collar 30. The 'Z' or 'S' shaped joint segments 42 are thus advantageous as they allow the collar sections 34 to adjust to fit different sizes of angle grinders without introducing unnecessary complexity into the shroud 10 and without compromising the integrity of the shroud. Once the collar sections 34 are clamped against the grinder, movement of the joint segments 42 is inhibited since the segments largely move in a radial direction, and movement of any individual segment 42 is inhibited as the radial direction of movement of the joint segment 42 is not in the same direction as the radial direction of movement of the adjacent joint segments 42, providing a mechanical interlock once clamped.

The shroud 10 includes holes 54 disposed around the outer edge of the body 14. As shown, the holes are placed in the top 18. According to a preferred embodiment of the shroud 10, the holes 54 are located around approximately one quarter of the perimeter of the shroud body 14 starting counterclockwise from the vacuum port 26. This improves the collection of dust and debris through the shroud.

The collar 30 and 'Z' joints 42 are formed with slots 38 extending beyond the grinder mounting surface, and are also formed with additional air passages 58 therethrough. The air passages 58 are located adjacent the bottom of the collar sections 34 and may extend into the 'Z' joints 42. These air passages 58, in combination with the slots 38, provide air flow across the grinder output bearings. Air flows in through the slots 38 and passages 58, across the bearings and output shaft of the grinder, and outwardly across the top of the grinding disk until collected in the vacuum port 26. This air flow is beneficial for a few reasons. The air flow helps to cool the grinder output shaft and bearings, increasing the life of the bearings and grinder transmission. Additionally, the air flow sweeps from the center of the top of the grinding disk to the edge of the grinding disk, keeping dust and debris from becoming entrained in the air above the grinding disk. This helps keep this dust from contacting the grinder output shaft bearings. Thus, the air passages 58 and slots 38 are designed to help prolong the life of the grinder. It is appreciated that the fine dust created while grinding concrete or the like is quite abrasive and will quickly ruin bearings if the bearings become contaminated with the dust. Providing an inflow of air adjacent the bearings helps to keep dust away from the bearings.

Figure 2:
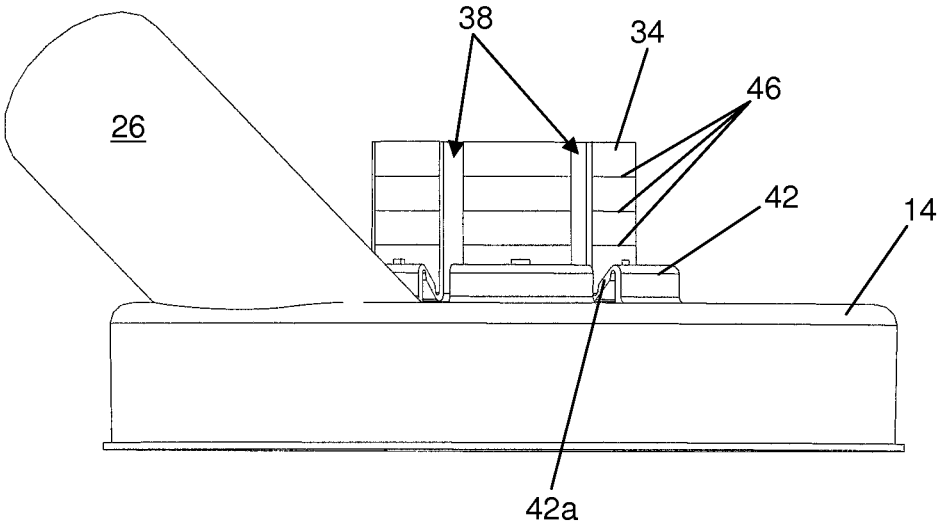
FIG. 2 shows a side view of the shroud of FIG. 1.

Turning now to FIG. 2, a side view of the shroud 10 of FIG. 1 is shown. For clarity, not all reference numbers are included. The shape of the 'Z' shaped joints 42 can be seen more clearly. As is shown, it is preferred that the joints 42 have a 'Z' shape formed by a vertical portion of the collar sections 34, a vertical outer wall, and a diagonal connecting wall 42*a*. These walls are preferably straight. The diagonal connecting section 42*a* is preferably oriented at an angle of 45 degrees or more from horizontal. That is to say that the diagonal connecting section is oriented closer to vertical than horizontal. The joint 42 as shown will allow the collar sections 34 to move inwardly and outwardly in a radial direction, but inhibit motion of the collar 30 relative to the body 14 in a radial direction. Orienting the diagonal connecting wall 42*a* closer to vertical than horizontal encourages radial movement of the collar section 34 while inhibiting axial movement of the sections. This improves the stability of the shroud and keeps the shroud properly located over the grinding disk.

Figure 3:
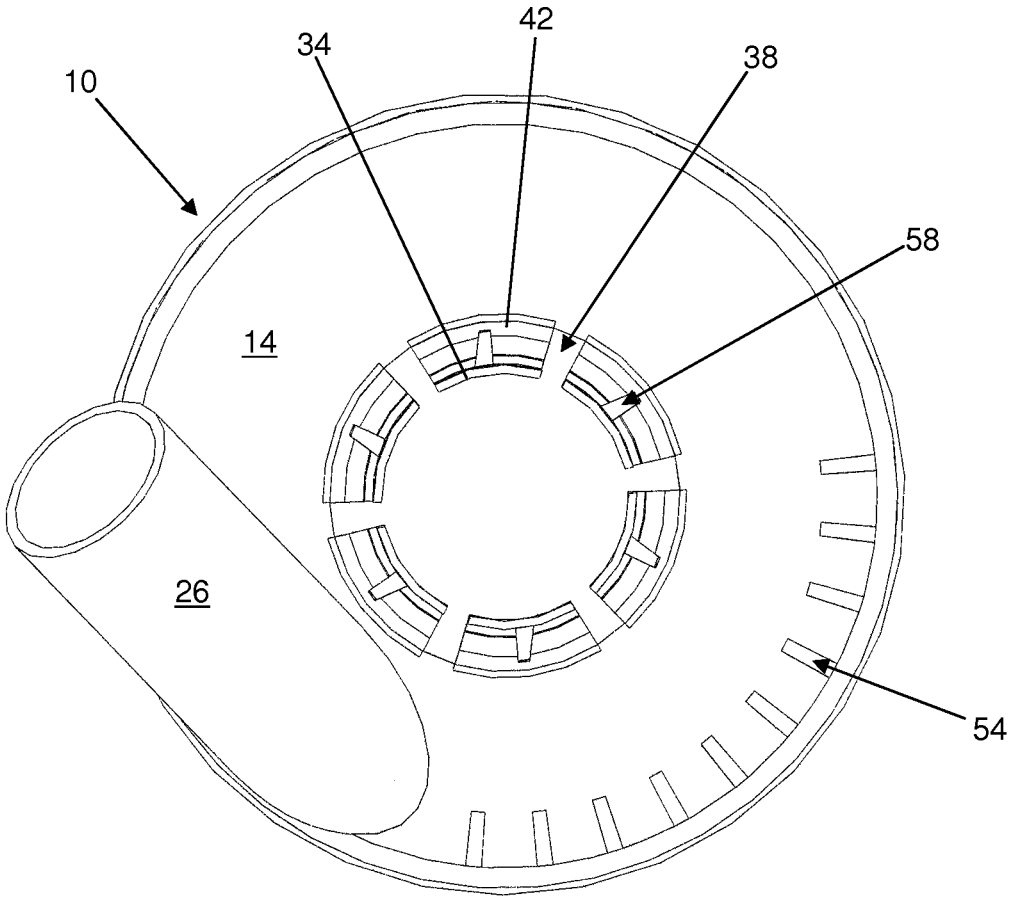
FIG. 3 shows a top view of the shroud of FIG. 1.
Figure 4:
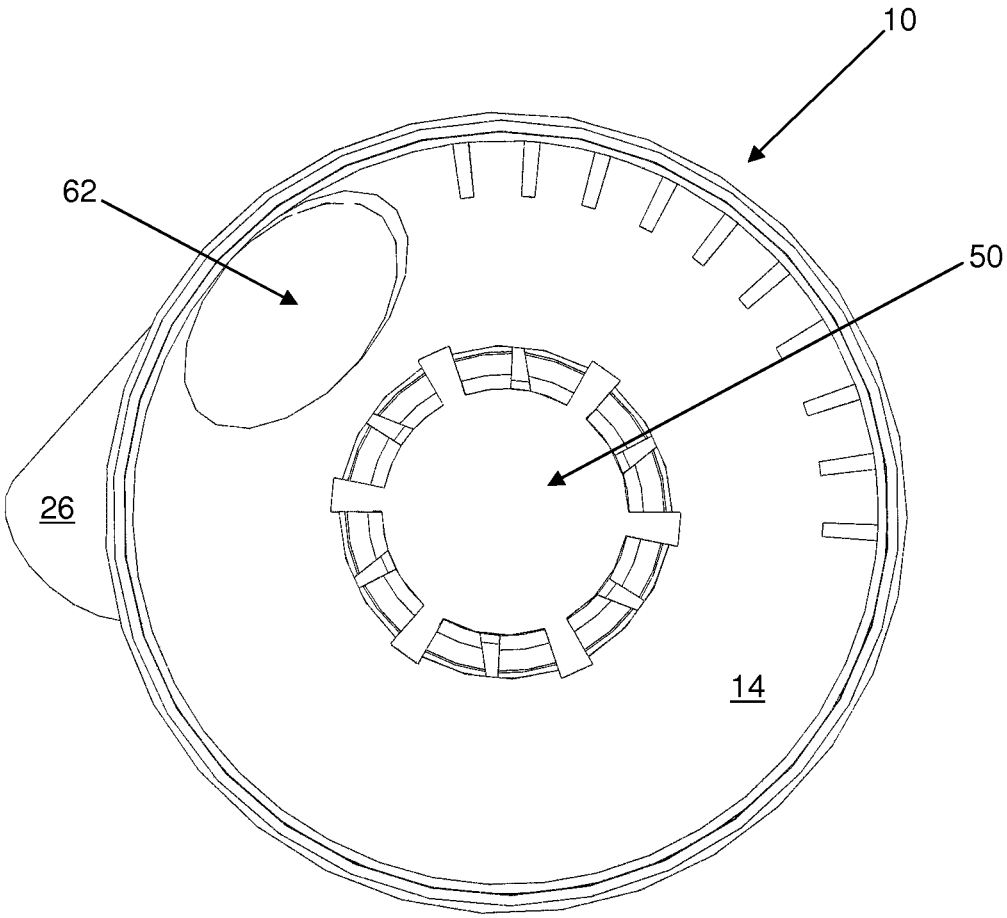
FIG. 4 shows a bottom view of the shroud of FIG. 1.

Turning now to FIG. 3, a top view of the shroud 10 is shown. The location of the air holes 54, slots 38, and air passages 58 can be better seen. FIG. 4 shows a bottom view of the shroud 10 and illustrates how the vacuum port 26 is connected to the interior of the shroud via a hole 62.

There is thus disclosed an improved dust shroud. It will be appreciated that numerous changes may be made to the present invention without departing from the scope of the claims.

What is claimed is:

1. A dust shroud for use with an angle grinder comprising:

a shroud body having an upper surface and a skirt extending downwardly therefrom so as to generally enclose a grinding disk in the interior thereof, the upper surface having an opening formed in the center thereof for allowing the shaft of an angle grinder to pass therethrough, the shroud extending horizontally from a central axis;

a vacuum port attached to the shroud body, the vacuum port being in fluid communication with the interior of the shroud body;

an attachment collar extending upwardly from the shroud body and around said opening in said center of the shroud body, the collar having a plurality of generally vertical slots therethrough such that the collar comprises a plurality of separated generally vertical sections; and a plurality of joints attached between the base of the collar and the top of the shroud body, each joint corresponding to one of the vertical sections of the collar, each joint comprising a first section which extends upwardly from the top of the shroud body and a second section which extends downwardly and inwardly from a top of the first section towards the center of the shroud body, the second section being disposed at an angle of about 45 degrees from horizontal, wherein the first sections and the second sections of the plurality of joints are separated from adjacent joints by the generally vertical slots and wherein the plurality of joints allow the vertical sections of the collar to move radially inwardly and outwardly to vary the size of the collar; and wherein the attachment collar sections extend upwardly from a bottom of the second section of the plurality of joints to a position above the plurality of joints.

2. The shroud of claim 1, further comprising air passages formed through the plurality of joints and the base of the collar sections, the air passages terminating near the plurality of joints such that the air passages do not extend into a portion of the collar sections disposed upwardly above the plurality of joints.

3. The shroud of claim 1, further comprising a plurality of holes formed adjacent the perimeter of the top surface, the plurality of holes consisting essentially of a series of holes extending across approximately one quarter of the circumference of the top surface, said quarter of the circumference being adjacent the vacuum port and being disposed counterclockwise from the vacuum port.

4. The shroud of claim 1, wherein, when viewed from above, the first section and the second section of the plurality of joints are arcuately shaped and concentric to the opening.

5. A system comprising the shroud of claim 1, and further comprising an angle grinder, wherein the collar sections are clamped to the output shaft housing of the grinder, wherein the grinder output shaft extends through the opening in the center of the shroud body, and wherein a grinding disk is positioned in the shroud body.

6. A dust shroud for use with an angle grinder comprising:

a shroud body having an upper surface and a skirt extending downwardly from the upper surface;

a vacuum port having a first end connected to the shroud body and having a second end configured for connection to a vacuum hose to thereby draw air from the shroud body, through the vacuum port, and into the vacuum hose;

a hole through the center of the shroud body upper surface;

a flex joint disposed around the hole, the flex joint comprising a plurality of flex joint sections, each of the plurality of flex joint sections comprising a first portion attached to the upper surface of the shroud and extending upwardly from the upper surface of the shroud, a second portion attached to the first portion and extending inwardly and downwardly towards the upper surface of the shroud at an angle of about 45 degrees relative to the upper surface of the shroud body; and a mounting collar extending around said hole, the mounting collar being formed from a plurality of collar sections, each of the plurality of collar sections being attached to the second portion of the flex joint section and extending upwardly therefrom to a height above the flex joint section, wherein the first portion and second portion of each the plurality of flex joint sections and the collar section attached thereto are separated from adjacent flex joint sections and collar sections by a slot, and wherein the collar sections may bend to move radially to thereby vary the size of the mounting collar.

7. The shroud of claim 6, wherein the mounting collar comprises slots between the collar sections and extending into the upper surface.

8. The shroud of claim 6, wherein the shroud has air passages formed through the plurality of flex joint sections, the air flow passages being disposed adjacent the base of the mounting collar and terminating adjacent the flex joint sections such that the air flow passages do not substantially extend into the mounting collar sections disposed above the flex joint sections.

9. The shroud of claim 6, wherein the shroud has a series of air passages consisting of a plurality of air passages which extend through the upper surface of the shroud adjacent the skirt, said series of air passages extending across approximately one quarter of the perimeter of the shroud, said one quarter of the shroud being located adjacent the vacuum port and extending counterclockwise therefrom.

10. The shroud of claim 6, wherein the mounting collar is attached to a grinder with a clamp.

11. A dust shroud for an angle grinder comprising:

a body having an upper surface and a skirt extending downwardly from the upper surface;

an opening formed in the center of the upper surface;

a vacuum port connected to the upper surface;

a flex joint attached to the upper surface of the shroud around the opening, the flex joint comprising multiple flex joint sections, each flex joint section comprising a first portion extending upwardly from the upper surface of the body and a second portion attached to the top of the first portion and extending downwardly and inwardly therefrom at an angle of about 45 degrees relative to the upper surface of the body, the first portion and the second portion of the flex joint sections being divided into separate flex joint sections;

an attachment collar attached to the flex joint, the attachment collar extending vertically above the flex joint and extending around the opening, the attachment collar being divided into vertical attachment collar sections corresponding to the multiple flex joint sections, the vertical collar sections being movable radially to vary the size of the attachment collar.

12. The shroud of claim 11, wherein, when viewed from above, the first portion and the second portion of the flex joint sections are arcuately shaped and concentric to the opening.

13. The shroud of claim 12, further comprising air passages disposed through the flex joint sections.

14. The shroud of claim 11, wherein the flex joints inhibit movement of the collar sections relative to the shroud body once the collar sections are clamped to a grinder.

15. The shroud of claim 11, wherein the shroud comprises air passages disposed in the flex joint sections and in the base of the attachment collar sections independent of slots dividing the collar into collar sections, said air passages terminating adjacent the top of the flex joint sections so as to not extend into the attachment collar sections above the flex joint sections.

16. The shroud of claim 15, wherein said air passages are formed through the second portion of the flex joint sections but not the first portion of the flex joint sections.

17. The shroud of claim 11, further comprising air passages through the upper surface of the body adjacent the skirt, the air passages consisting of a series of openings beginning adjacent the vacuum port and extending counterclockwise therefrom for about one quarter of the perimeter of the shroud.

18. The shroud of claim 11, further comprising horizontal lines formed on the attachment collar for allowing a user to cut the attachment collar at a desired height.

* * * * *